US007985531B2

(12) United States Patent
Kanri et al.

(10) Patent No.: US 7,985,531 B2
(45) Date of Patent: Jul. 26, 2011

(54) METHOD OF PRODUCING AN INK JET HEAD AND METHOD OF PRODUCING AN ELECTRONIC DEVICE

(75) Inventors: Ryoji Kanri, Zushi (JP); Tamaki Sato, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 792 days.

(21) Appl. No.: 12/042,695

(22) Filed: Mar. 5, 2008

(65) Prior Publication Data

US 2008/0227035 A1 Sep. 18, 2008

(30) Foreign Application Priority Data

Mar. 15, 2007 (JP) ..... 2007-066585

(51) Int. Cl.
*B41J 2/16* (2006.01)

(52) U.S. Cl. ..... 430/320; 216/27

(58) Field of Classification Search ..... None
See application file for complete search history.

(56) References Cited

U.S. PATENT DOCUMENTS

| | | | | |
|---|---|---|---|---|
| 5,478,606 | A | 12/1995 | Ohkuma et al. | |
| 6,461,798 | B1 | 10/2002 | Ohkuma et al. | |
| 2005/0248623 | A1 | 11/2005 | Komuro et al. | |
| 2006/0114295 | A1 | 6/2006 | Asai et al. | |
| 2006/0125884 | A1 | 6/2006 | Sato et al. | |
| 2006/0256162 | A1* | 11/2006 | Hayakawa | 347/65 |
| 2006/0277755 | A1 | 12/2006 | Kubota et al. | |
| 2007/0099121 | A1 | 5/2007 | Kubota et al. | |
| 2007/0252872 | A1 | 11/2007 | Fujii et al. | |
| 2008/0173616 | A1* | 7/2008 | Sakurai | 216/27 |

FOREIGN PATENT DOCUMENTS

| | | | |
|---|---|---|---|
| JP | 9-11478 | | 1/1997 |
| JP | 10-128985 | A * | 5/1998 |

OTHER PUBLICATIONS

Computer-generated translation of JP 10-128-985 (May 1998).*

* cited by examiner

*Primary Examiner* — John A. McPherson
(74) *Attorney, Agent, or Firm* — Fitzpatrick, Cella, Harper & Scinto

(57) ABSTRACT

Provided is a method of producing an ink jet head including: providing the substrate which includes a through hole which forms the supply opening, and a layer that covers an opening of the through hole on a side of the one surface of the substrate; forming a protective film so that the protective film covers a side wall of the through hole and reaches the layer; depositing a photosensitive resin on the protective film; applying light from the side of the one surface of the substrate to pattern the photosensitive resin; and removing the protective film formed on a portion of the opening of the through hole on the side of the one surface of the substrate, with the patterned photosensitive resin being used as a mask.

5 Claims, 8 Drawing Sheets

METHOD OF PRODUCING AN INK JET HEAD AND METHOD OF PRODUCING AN ELECTRONIC DEVICE

BACKGROUND OF THE INVENTION

1. Field of the Invention

The present invention relates to a method of producing an ink jet head for generating a liquid droplet used for an ink jet recording method. In addition, the present invention relates to a method of producing an electronic device having a through electrode for establishing electrical connection by employment of a back surface mount technology.

2. Description of the Related Art

As an ink jet head used for an ink jet recording method, there is known an ink jet head as disclosed in U.S. Pat. No. 6,461,798. In the ink jet head, an ink supply opening for supplying ink to an ink flow path is formed in a silicon substrate.

Japanese Patent Application Laid-Open No. H09-011478 discloses a technology for forming a protective film on an inner wall of a supply opening so as to protect a silicon inner wall of the supply opening of the ink jet head from ink or the like. For example, the inner wall of the supply opening formed by employment of dry etching has a property to be easily dissolved in an alkaline solution as compared with an etching surface obtained by crystal anisotropic etching.

In a case where a substrate is etched and an ink protective film is formed on an inner wall of the etched substrate, it is necessary to selectively form the protective film on the inner wall of the supply opening.

Such a demand is also made in a case of forming a through electrode of the substrate which is used for three-dimensional mounting of an electronic device chip. In other words, the same demand is made regarding a method of forming a through electrode, for example, a method in which the substrate is subjected to dry etching to form a through hole, an insulating film is formed on an inner wall thereof, and then, the electrode is formed in the hole.

SUMMARY OF THE INVENTION

In view of the foregoing, it is an object of the present invention to provide a method of selectively forming a protective film, with high accuracy, on an inside of an ink supply opening of an ink jet head. Another object of the present invention is to provide a method of reliably forming an insulating film for a through electrode in a through hole in a case of forming the through electrode in the through hole penetrating the substrate.

According to an aspect of the present invention, there is provided a method of producing an ink jet head, the ink jet head including: a substrate having an element formed on one surface thereof, for generating energy utilized for discharging an ink through a discharge port; and a supply opening formed so as to penetrate the substrate, for supplying the ink to the discharge port, the method including: providing the substrate which includes a through hole which forms the supply opening, and a layer that covers an opening of the through hole on a side of the one surface of the substrate; forming a protective film so that the protective film covers a side wall of the through hole and reaches the layer; depositing a photosensitive resin on the protective film; applying light from the side of the one surface of the substrate to pattern the photosensitive resin; and removing the protective film formed on a portion of the opening of the through hole on the side of the one surface of the substrate, with the patterned photosensitive resin being used as a mask.

According to the present invention, when light is applied from the front surface side of the substrate, the light is selectively applied only to a penetrated portion of the inner portion of the ink supply opening, whereby blur of a pattern due to vignetting of light, and unexpected exposure due to the vignetting, can be prevented.

In the case of applying the light from the front surface of the substrate, sufficient light for exposing the photoresist of the penetrated portion may be applied. Further, the use of a photomask when the light is applied from the front surface side of the substrate enables formation of a pattern with high accuracy, which is effective.

In addition to the production of the ink supply opening, the method of forming the through electrode can be applied also to a process for etching the substrate by employment of dry etching, and forming the insulating film on the inner wall thereof to pattern only the penetrated portion for conducting the electrode by use of a photosensitive resist.

Further features of the present invention will become apparent from the following description of an exemplary embodiment with reference to the attached drawings.

DESCRIPTION OF THE EMBODIMENT

Figure 1A:
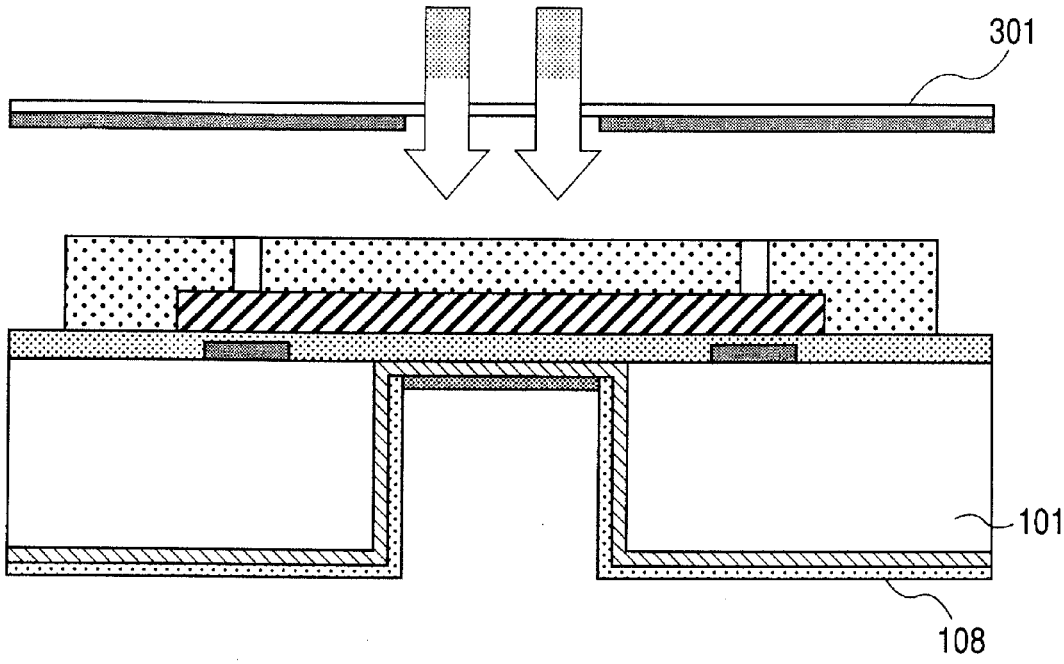
FIGS. 1A and 1B are schematic cross-sectional diagrams each illustrating an example of a method of producing an ink jet head according to the present invention.

Hereinafter, an embodiment of the present invention will be described with reference to the drawings. Note that, in the following description, components having the same functions are denoted by the same reference numerals in the drawings, and descriptions thereof are omitted in some cases.

In the following description, as application examples of the present invention, examples of the embodiment of the present invention will be described in detail.

Figure 8:
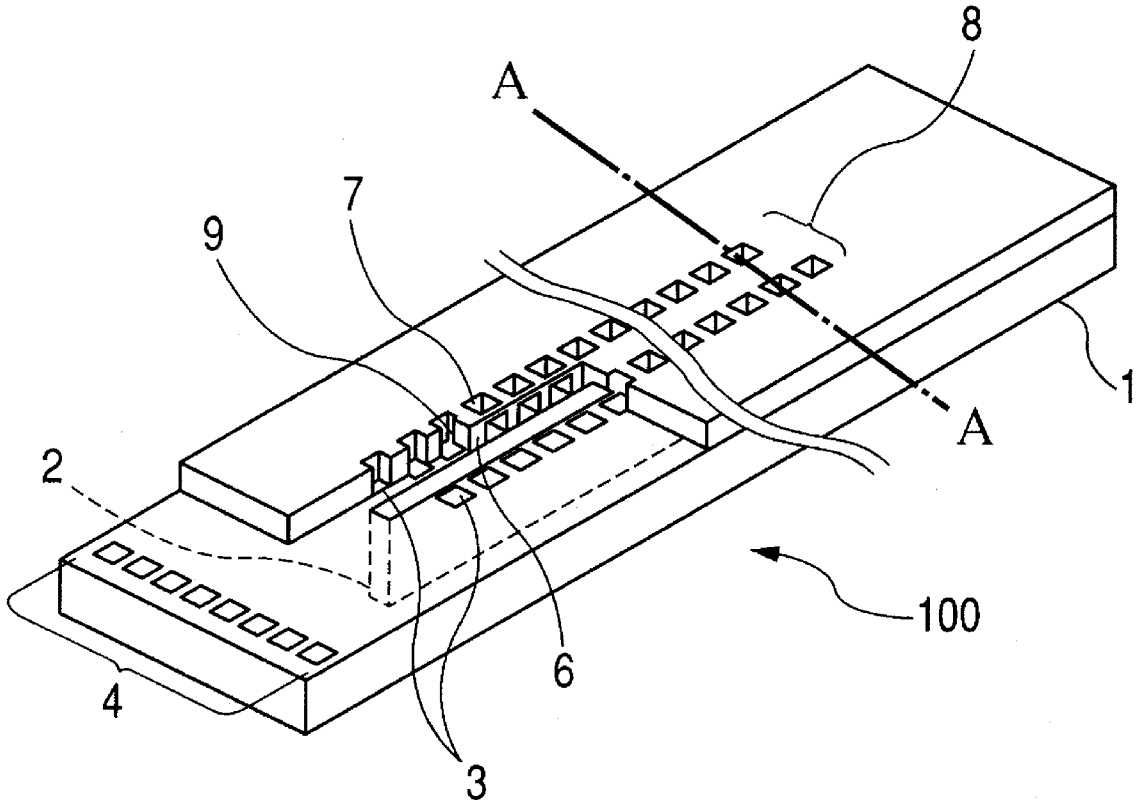
FIG. 8 is a schematic perspective view illustrating an example of an ink jet head according to the present invention.

FIG. 8 is a schematic perspective view illustrating an example of an ink jet head according to the present invention.

On a front surface of an ink jet head 100, discharge ports 7 for discharging a recording liquid such as an ink are formed, and the multiple discharge ports 7 are arranged in rows, to thereby form discharge port arrays 8. Those discharge ports are each formed of a discharge port forming member 6. On a back surface side of the ink jet head 100, a liquid supply opening 2 for supplying the recording liquid is formed with substantially the same length as that of the discharge port array 8. The ink such as the recording liquid is supplied to a bubble chamber 9 (liquid chamber) through the liquid supply opening 2. Then, owing to heat generation by electrothermal transducing elements 3 each of which serves as a discharge energy generating element provided on a substrate 1, the liquid contained in the bubble chamber 9 (recording liquid such as ink in this embodiment) bubbles, whereby the liquid is discharged from the discharge ports 7. In addition, on an end portion of the substrate of the ink jet head 100, multiple electrode pads 4 for supplying electrical signals or electric power for the heat generation to the electrothermal transducing elements 3 and the like.

Next, a description is given of an example of a method of producing each of an ink jet head and an electronic device according to the present invention.

FIGS. 3A, 3B, 3C, and 3D and FIGS. 4A, 4B, 4C, and 4D are schematic cross-sectional diagrams each illustrating an example of a method of producing an ink jet head according to the present invention, and are each viewed from a position of a cross section which is taken along the line A-A of FIG. 8 and perpendicular to the substrate.

Figure 3A:
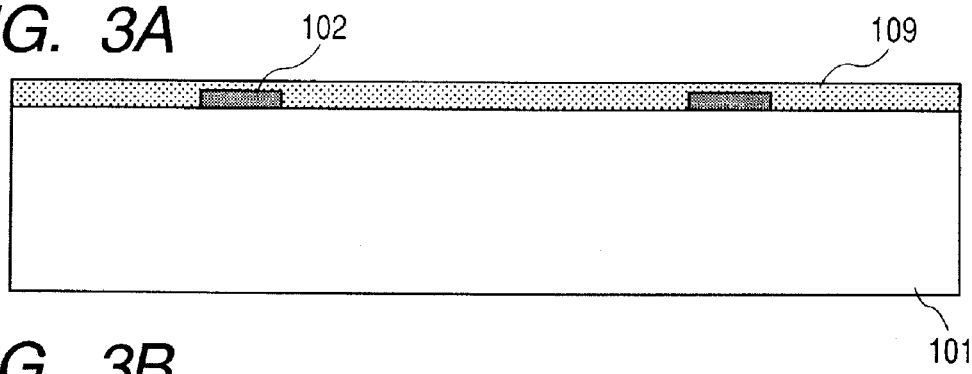
FIGS. 3A, 3B, 3C, and 3D are schematic cross-sectional diagrams each illustrating an example of the method of producing an ink jet head according to the present invention.

First, as illustrated in FIG. 3A, there is provided a substrate 101 having multiple energy generating elements 102 for generating energy utilized for discharging ink and multiple element driving circuits formed on one surface thereof.

Next, on the substrate, as a resin layer which can be dissolved later, a pattern layer 103 which forms an ink flow path mold material is formed by use of a photosensitive material. The photosensitive material is formed by a method such as spin coating of a resist and lamination of a dry film, and UV light, Deep-UV light, or the like is applied through a photomask, to thereby form a pattern. After that, a description is made assuming that, on the substrate, a surface on a side on which the energy generating elements are formed is a front surface. The front surface of the substrate refers to a surface on which ink discharge ports or electrical wirings and circuits are formed in addition to the energy generating elements, and the surface is represented as a front surface side in the cross-sectional diagrams to be described later. A back surface of the substrate refers to an opposite surface which is opposite to the front surface of the substrate, and in a similar manner, the surface is represented as a back surface side in the cross-sectional diagrams.

Figure 3B:
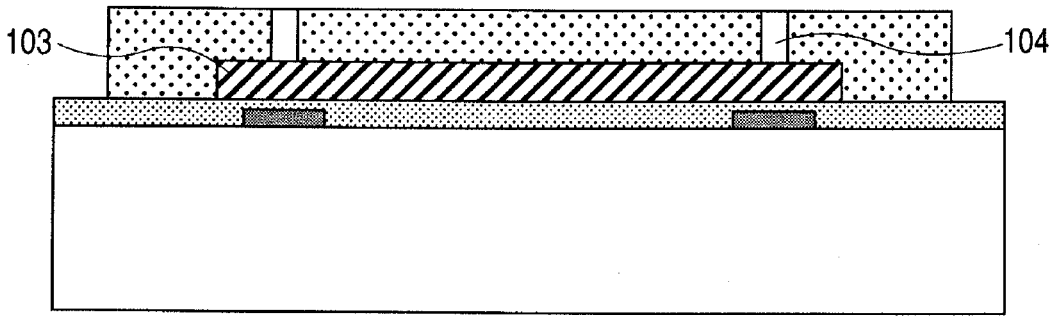

Then, a negative-type photosensitive resin is subjected to spin coating, exposure, and development, on the pattern which forms the ink flow path mold material, to thereby form ink discharge ports 104. Thus, a state illustrated in FIG. 3B is obtained.

The above-mentioned formation of each of the ink discharge ports and the ink flow path mold material may be performed after formation of each of an ink supply opening and an ink protective film to be described later.

Then, the formed ink discharge ports are protected. As a protective material, a protective tape or a resist material having resistance to heat, or a protective substrate such as a glass substrate may be bonded (not shown), in consideration of a process for heating the protective material later.

Figure 3C:
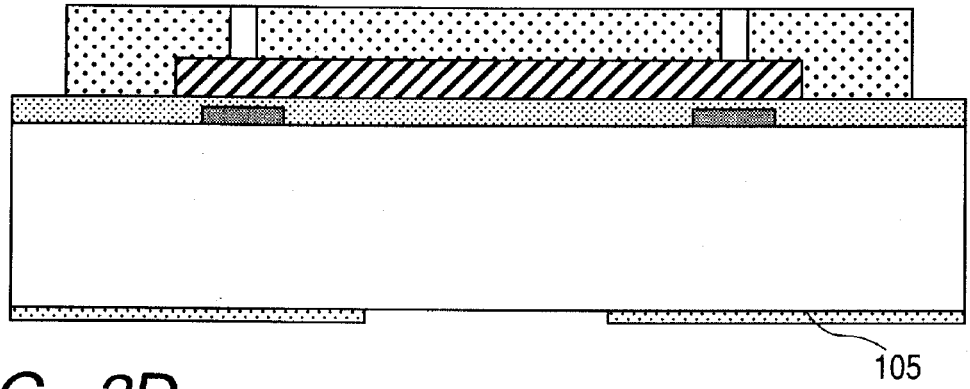

Then, as illustrated in FIG. 3C, by use of a photoresist 105, a pattern for the ink supply opening is formed on the back surface of the substrate.

Figure 3D:
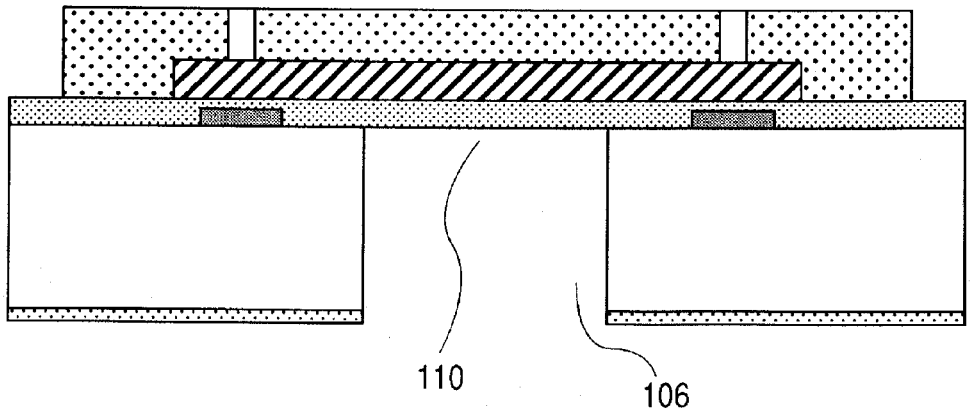

As illustrated in FIG. 3D, the substrate is etched with the resist pattern being used as a mask, to thereby form a through hole 106 which forms the ink supply opening. In this case, the substrate is etched from a side of the back surface. At that time, an opening 110 is formed on the front surface side of the substrate, with the result that an etching stop layer 109 formed on the front surface of the substrate is exposed so as to cover the opening 110. In this case, the etching stop layer 109 may be removed to thereby expose the pattern layer 103.

The etching for forming the ink supply opening can be performed by various methods, but there is generally employed dry etching using a so-called Bosch process capable of obtaining a vertical etching cross section by repeating etching and deposition of a protective film.

Figure 4A:
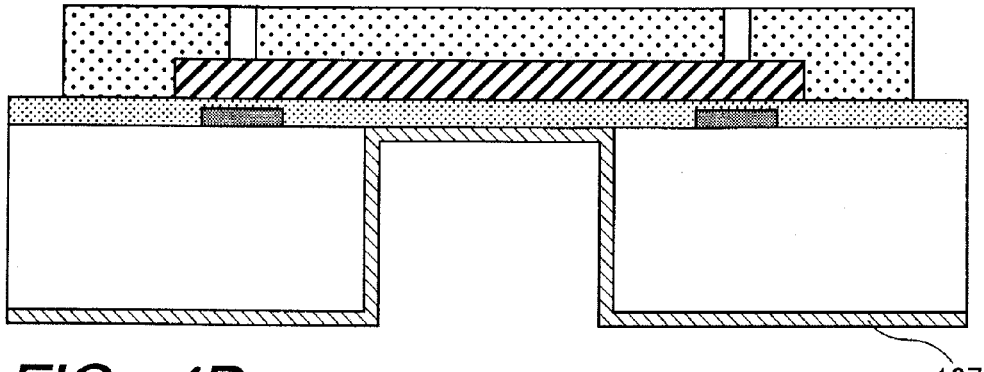
FIGS. 4A, 4B, 4C, and 4D are schematic cross-sectional diagrams each illustrating an example of the method of producing an ink jet head according to the present invention.

By use of an oxygen plasma or an organic solvent, the resist pattern used as the mask is removed, and then, as illustrated in FIG. 4A, on an inner wall of the ink supply opening and the back surface of the substrate, an ink-resistive protective film 107 is formed. The protective film can be formed so as to cover the inner wall of the through hole to be protected from corrosion caused by the ink or discharged liquid. In this case, the protective film 107 reaches the etching stop layer 109 covering an opening 212 of the through hole 106, which is formed on the front surface side of the substrate. Various chemical-resistant materials can be formed by various methods. For example, there can be employed a method of coating polyether amide resin, benzocyclobutene resin, or the like by use of a spray device, and a method of coating parylene resin, silicon oxide, silicon nitride, or the like by employment of a CVD method. In this case, the protective film is formed so that a penetrated portion of the supply opening as well as the inner wall of the supply opening are covered.

Figure 1B:
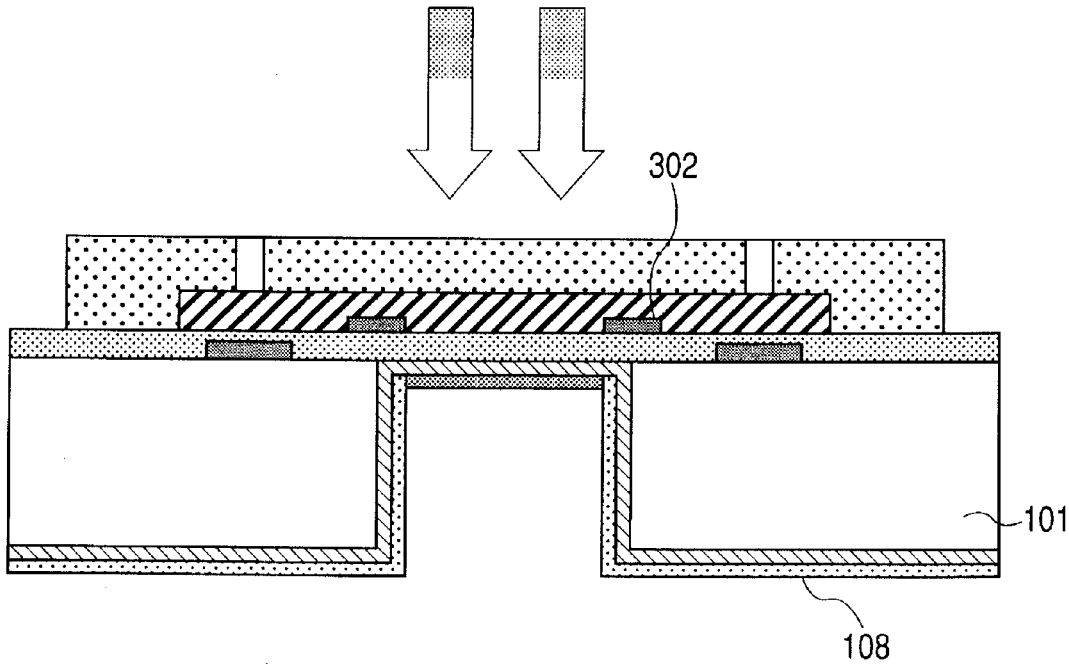

Then, a positive-type photosensitive resin 108 is coated by use of the spray device so as to deposit a resist mask on the protective film, and then, light is applied from the front surface side of the substrate so as to pattern the resist as illustrated in FIG. 1A. A typical contact aligner, proximity aligner, projection aligner, and a photomask 301 can be used. With an appropriate amount of irradiation, the resist formed at least on the opening can be exposed without using the photomask. In order to perform the pattern formation with high accuracy, the photomask 301 can be used. As illustrated in FIG. 1B, by use of a film made of aluminum used for electrical wiring, tantalum used for the electrothermal transducing element, or the like on the substrate, a light-shielding film 302 for a desired pattern can be formed in advance. As a result, the pattern formation can be performed with high accuracy without using the photomask. In the above-mentioned process, in a portion other than the inner portion of the opening 110, which is the penetrated portion, the light is blocked off by silicon, whereby the exposure on the back surface of the substrate can be avoided.

Figure 4B:
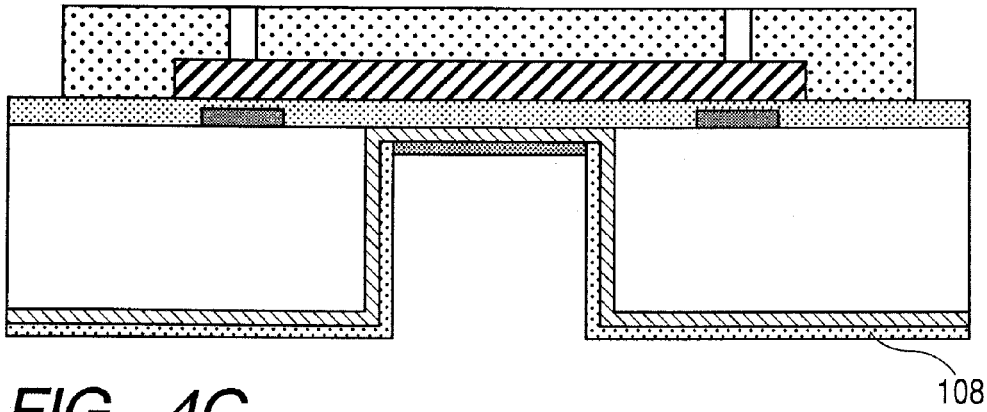

In this case, as the silicon oxide formed as the ink flow path material, the ink discharge port forming member, and the etching stop layer, there can be used a silicon oxide which transmits light having a photosensitive wavelength range for the resist to be patterned, to some extent. Thus, as illustrated in FIG. 4B, in a range from the resist mask 108 to the protective film 107, a portion corresponding to the opening 110 is exposed.

Figure 2A:
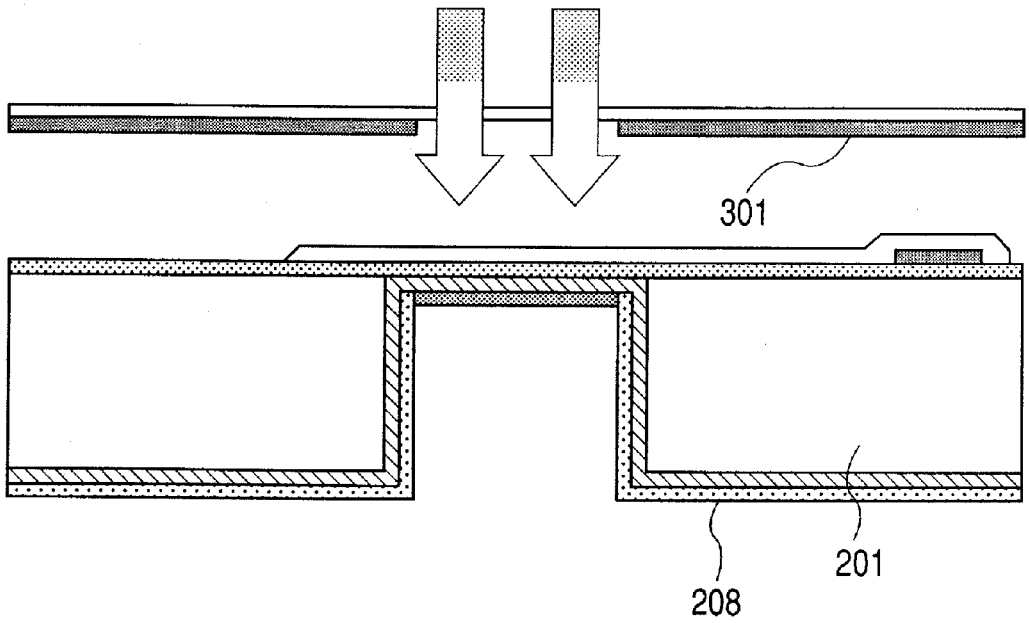
FIGS. 2A and 2B are schematic cross-sectional diagrams each illustrating an example of a method of forming a through electrode according to the present invention.
Figure 2B:
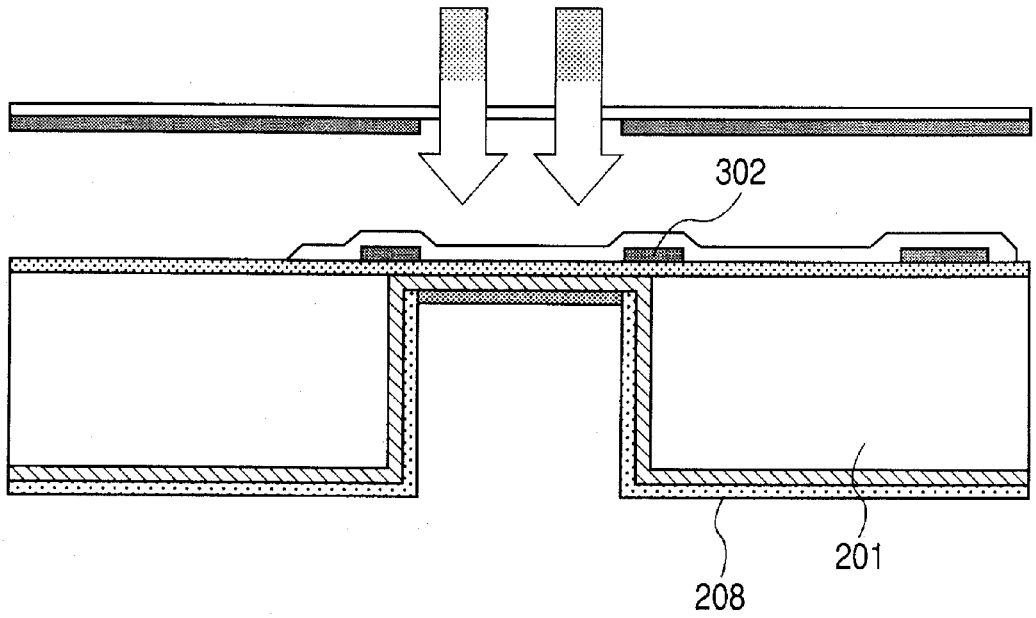

Also in a case of the electronic device whose through electrode is to be formed later, as illustrated in FIGS. 2A and 2B, light is applied to a positive-type photosensitive resist 208 from the front surface side of a substrate 201, thereby enabling formation of an etching mask.

Figure 4C:
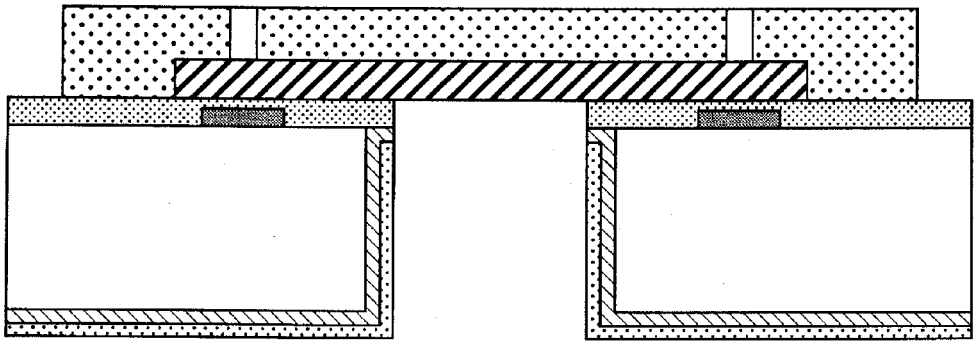

Then, as illustrated in FIG. 4C, the ink protective film is etched with the patterned resist being used as a mask. Various etching methods can be employed depending on various protective films. Subsequently, the silicon oxide serving as the etching stop layer is etched. There can be employed dry etching using oxide and $CF_4$ gas or etching using an aqueous hydrofluoric acid solution or a buffered aqueous hydrofluoric acid solution. As a result, a portion of the protective film 107, which is formed on a portion corresponding to the opening 110, is removed.

Figure 4D:
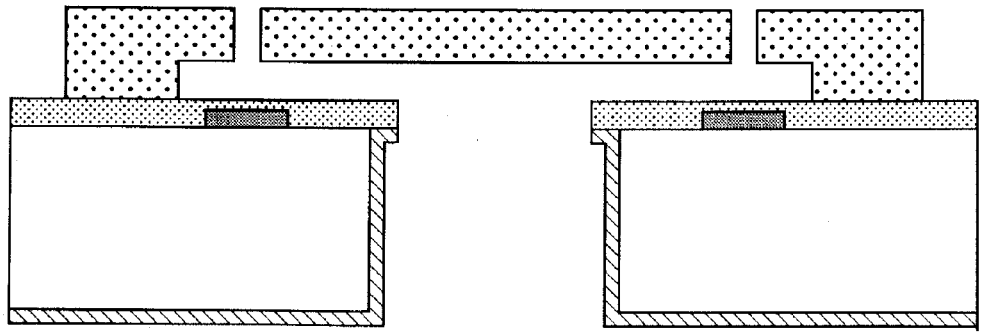

Then, as illustrated in FIG. 4D, a remaining positive resist is removed by use of an oxygen plasma or an organic solvent. In addition, UV light and Deep-UV light are applied to the ink flow path mold material, and then, the ink flow path mold material is applied with supersonic waves while being immersed in the organic solvent, to thereby remove the mold material.

By the above-mentioned process, the substrate having a nozzle part formed thereon is diced into chips with a dicing saw or the like, and a tank member for supplying ink is connected after electrical connection (not shown) for driving the energy generating elements is established, whereby the ink jet head is completed.

In the above-mentioned process, in the case of patterning the opening of the ink supply opening, an effect of vignetting of light due to a step of the ink supply opening is eliminated, and the penetrated portion of the ink supply opening is patterned with high accuracy and with reliability, whereby the protective film is formed on the inner wall of the ink supply opening. In addition, the inner wall of the ink supply opening is reliably protected from the discharged liquid, with the result that there can be provided an inexpensive and highly reliable ink jet head, and a production method therefor.

Hereinafter, the present invention will be described in more detail by illustrating two examples.

EXAMPLES

Example 1

In Example 1 of the present invention, an ink jet head was formed by the above-mentioned process.

First, the substrate 101 having the energy generating elements 102, element driving circuits (not shown), and the etching stop layer 109 disposed thereon was provided (see FIG. 3A).

Next, on the substrate, the pattern 103 which forms the ink flow path mold material is formed as a resin layer that can be dissolved later. In this case, ODUR-1010 manufactured by TOKYO OHKA KOGYO CO., LTD. was patterned by irradiation of Deep-UV light with an irradiation amount of about 20000 mJ/cm$^2$ by use of UX-3000 manufactured by USHIO INC. Then, on the pattern which forms the ink flow path mold material, a negative-type photosensitive resin with compositions represented in the following Table 1 was coated by spin coating. Then, the resin layer was exposed by UV light of a mirror projection aligner (MPA-600Super) manufactured by Canon Inc. to be developed, whereby the ink discharge ports 104 were formed (see FIG. 3B).

TABLE 1

| | | |
|---|---|---|
| epoxy resin | polyfunctional epoxy resin with oxycyclohexane skeleton (EHPE-3150 manufactured by DAICEL CHEMICAL INDUSTRIES, LTD.) | 100 parts |
| cationic photopolymerization initiator | 4.4'-di-t-butyl-phenyl-iodonium hexafluoroantimonate | 0.5 parts |
| reducing agent | copper triflate | 0.5 parts |
| silane coupling agent | A-187 manufactured by Nippon Unicar Company Limited | 5 parts |

Then, a protective tape (not shown) was applied so as to protect the formed ink discharge ports. In this case, SP6002T-115 resistant to heat and manufactured by THE FURUKAWA ELECTRIC CO., LTD. was used.

Then, a photoresist (OFPR-800 manufactured by TOKYO OHKA KOGYO CO., LTD.) was used to form the ink supply opening pattern 105 on the back surface of the substrate (see FIG. 3C). With the resist pattern being used as a mask, the substrate was etched by use of an ICP plasma dry etching device, that is, AMS-200 manufactured by Alcatel Ltd., to thereby form the ink supply opening 106 (FIG. 3D). After the resist pattern being used as the mask was removed by use of the organic solvent, the ink-resistive protective film 107 is formed on the inner wall of the ink supply opening and the back surface of the substrate. In this case, HIMAL1210 manufactured by Hitachi Chemical Co., Ltd. is diluted to a viscosity of about 20 cPs by diglyme to be coated by use of a microspray device manufactured by Nordson Corporation (see FIG. 4A). In this case, the protective tape previously applied for protection of the ink discharge port was removed. The protective tape having high resistance to heat was used in this case because an adhesive agent changes in quality during a heating process to be subsequently performed for a long period of time, which makes it difficult to remove the protective tape. Note that, though not described in detail below, it is necessary to prevent the ink discharge ports from being mechanically and chemically damaged, by performing the application and removal of the protective tape as needed. After the HIMAL is heated for an hour at 150° C. to be hardened, as the positive-type resist 108, AZP4620 manufactured by Clariant was diluted to a viscosity of about 10 cPs by PEGMEA solvent to be coated by use of the microspray device in a similar manner (see FIG. 4B).

The patterning of the resist is performed by applying the light from the front surface side of the substrate. The ink flow path mold material and the ink discharge port forming member absorb UV light having a photosensitive wavelength range between a Deep-UV region and an i-line region, but has little absorption in a g-line region which corresponds to a photosensitive wavelength range of AZP4620. Further, the silicon oxide formed as the etching stop layer 109 also transmits the UV light, so the light applied from the front surface side of the substrate can expose the resist provided in the ink supply opening. In this case, Projection Aligner UX-4031 manufactured by USHIO INC. and the photomask 301 were used to perform exposure (see FIG. 1A).

Then, with the patterned resist being used as a mask, the HIMAL serving as the ink protective film was etched by chemical dry etching using an oxygen plasma. Subsequently, the silicon oxide serving as the etching stop layer was removed by etching using a buffered aqueous hydrofluoric acid solution (BHF-110U manufactured by DAIKIN INDUSTRIES, Ltd.) (see FIG. 4C).

Then, the remaining positive resist was removed with Microposit Remover 1112 A.

Then, the Deep-UV light was applied to the ink flow path mold material, and then, the mold material was applied with supersonic waves while being immersed in methyl lactate, to be removed.

Finally, a heating process was performed for an hour at 200° C., and the resin forming the ink discharge ports was completely hardened, whereby the ink jet head was completed (see FIG. 4D).

Example 2

In Example 2 of the present invention, an electronic device having a through hole penetrating a substrate was produced.

Figure 5A:
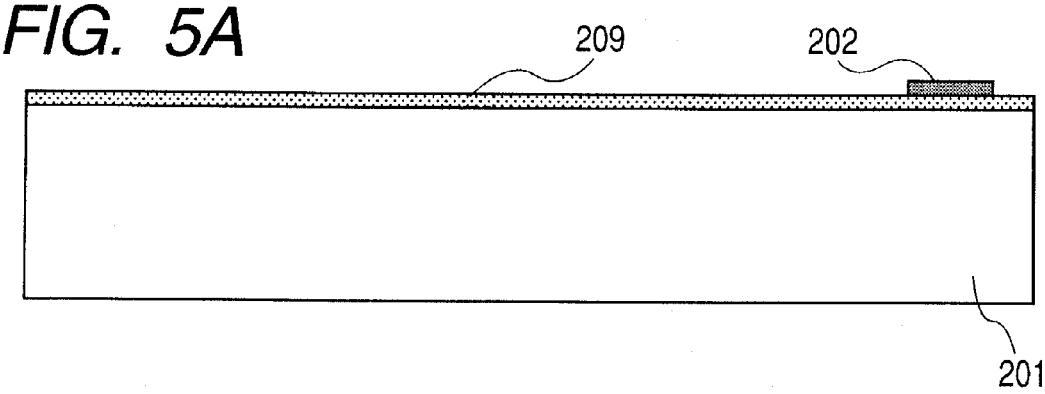
FIGS. 5A, 5B, 5C, and 5D are schematic cross-sectional diagrams each illustrating an example of the method of forming a through electrode according to the present invention.
Figure 5B:
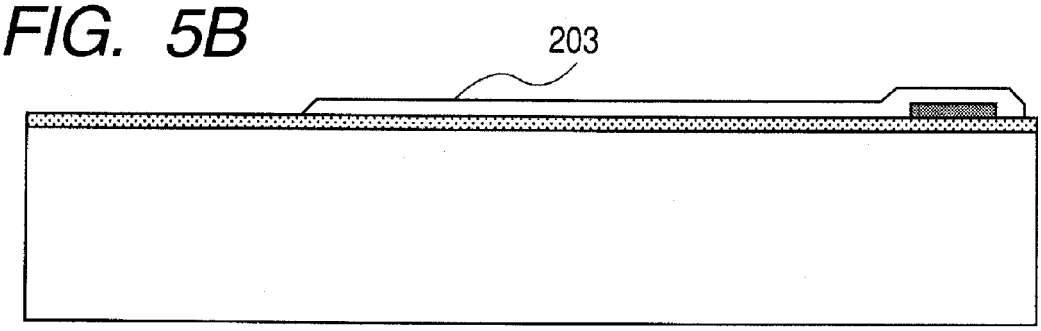

First, on the substrate 201 having an aluminum wiring pattern 202 formed thereon as illustrated in FIG. 5A, an indium oxide thin film (ITO) was formed as a transparent electrode 203 (see FIG. 5B) The ITO was formed to provide the penetrated portion with optical transparency, so a pattern may be formed at least on the penetrated portion and the vicinity thereof.

Figure 5C:
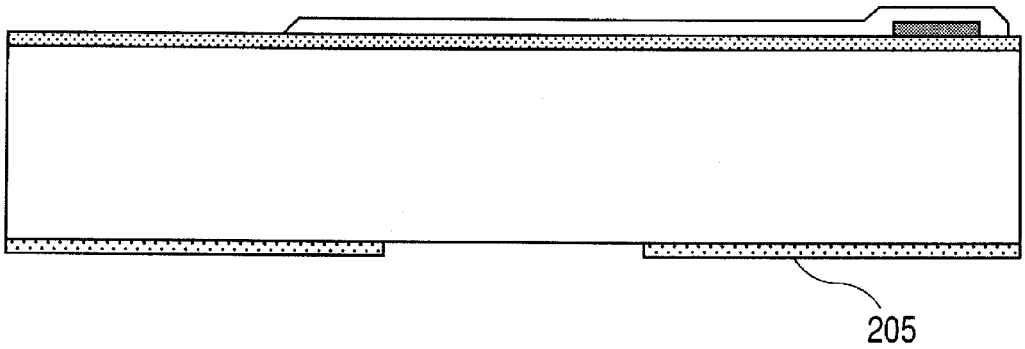
Figure 5D:
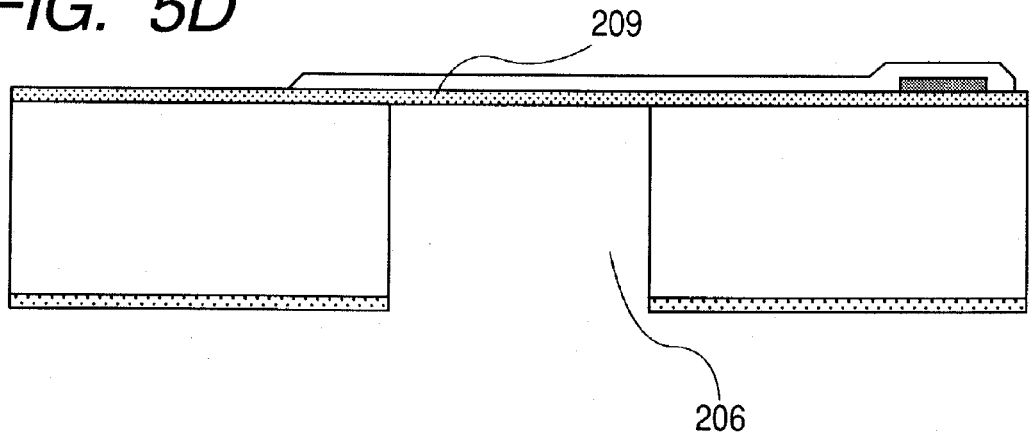
Figure 6A:
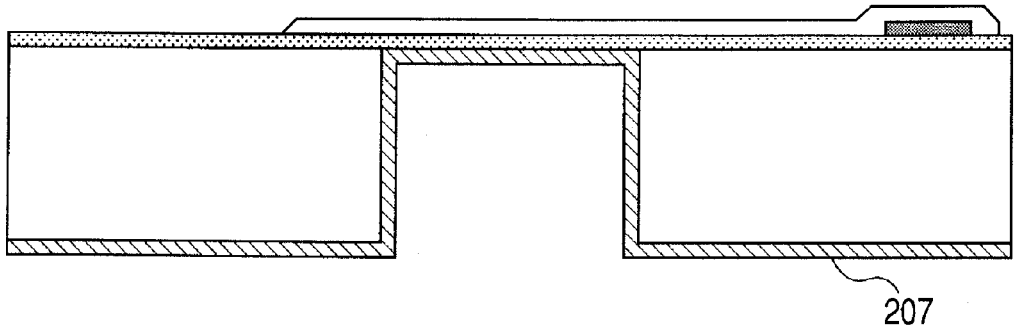
FIGS. 6A, 6B, 6C, and 6D are schematic cross-sectional diagrams each illustrating an example of the method of forming a through electrode according to the present invention.

Next, by use of a photoresist (OFPR-800 manufactured by TOKYO OHKA KOGYO CO., LTD.), a through electrode pattern 205 was formed on the back surface of the substrate (see FIG. 5C). With the resist pattern being used as a mask, the substrate was etched by use of the ICP plasma dry etching device, that is, AMS-200 manufactured by Alcatel Ltd., to thereby form a through hole 206 (see FIG. 5D). The resist pattern used as the mask was removed by use of the organic solvent, and then, an insulating film 207 was formed on the inner wall of the through hole and the back surface of the substrate. In this case, silicon oxide was formed by plasma CVD (see FIG. 6A).

Figure 6B:
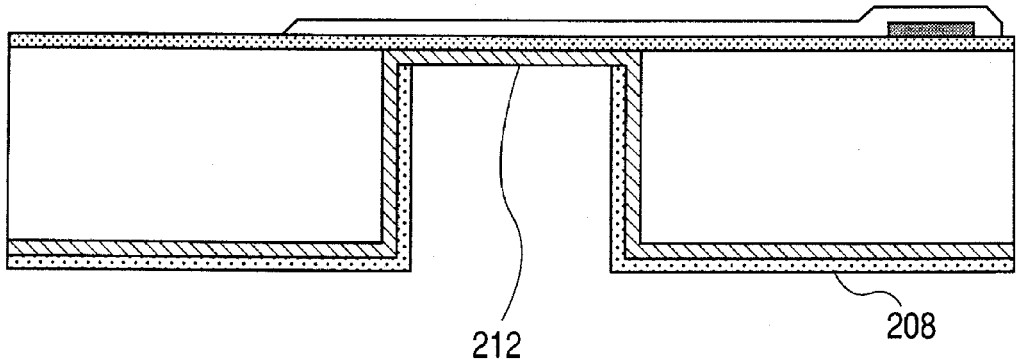

Then, as the positive-type resist 208, AZP4620 manufactured by Clariant was diluted to a viscosity of about 10 cPs by PGMEA solvent to be coated by use of the microspray device manufactured by Nordson Corporation (see FIG. 6B).

The patterning of the resist is performed by applying the light from the front surface side of the substrate. As described above, the ITO film has the property to transmit UV light, and the light applied from the front surface side of the substrate can expose the resist provided in the through hole. In this case, Projection Aligner UX-4031 manufactured by USHIO INC. and the photomask 301 were used to perform exposure (see FIG. 2A).

Note that, in the case of applying the light from the front surface side of the substrate, the photomask can be used, or a light-shielding film pattern can be formed on the substrate in advance in the same manner as in the above-mentioned example of the production of the ink jet head. The penetrated portion may be formed by the above-mentioned process, and then, the electric wiring pattern may be formed from the front surface side of the substrate. In addition, when a conductive transparent film is used for at least a part of the electric wiring pattern of the through electrode on the front surface side of the substrate, the light passes therethrough even when the wiring pattern is formed in advance, which facilitates the process and is more effective.

Figure 6C:
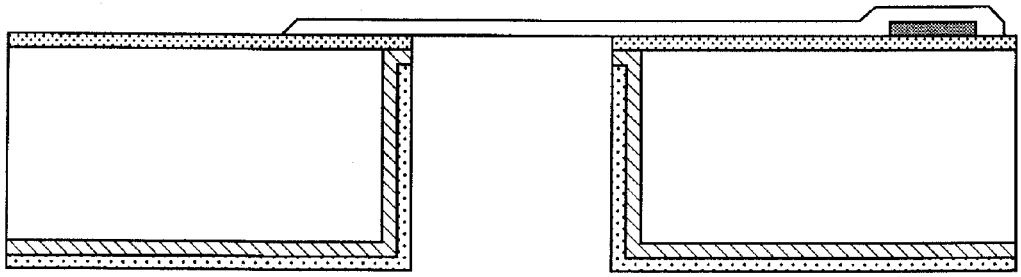

Then, with the patterned resist being used as a mask, a portion of the silicon oxide serving as the ink protective film, which was formed on the penetrated portion 212, was etched by reactive ion etching using $CF_4$ gas. Simultaneously, the silicon oxide serving as an etching stop layer 209 was removed (see FIG. 6C).

Figure 6D:
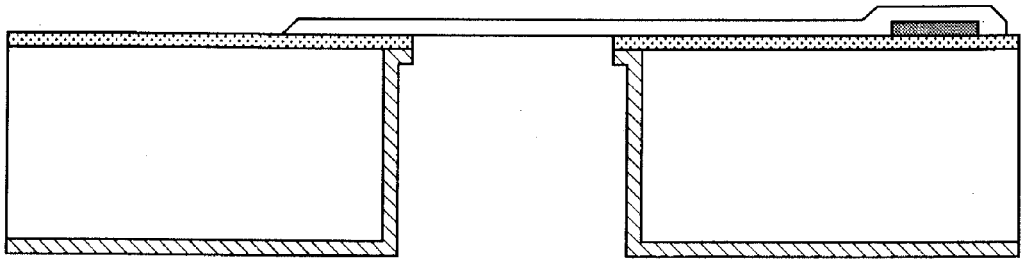

Then, the remaining positive resist was removed with an organic solvent (see FIG. 6D).

Figure 7A:
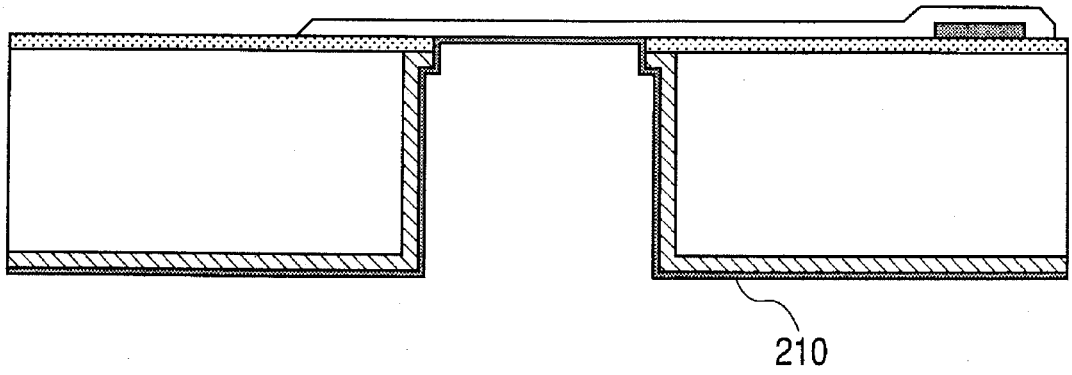
FIGS. 7A, 7B, and 7C are schematic cross-sectional diagrams each illustrating an example of the method of forming a through electrode according to the present invention.
Figure 7B:
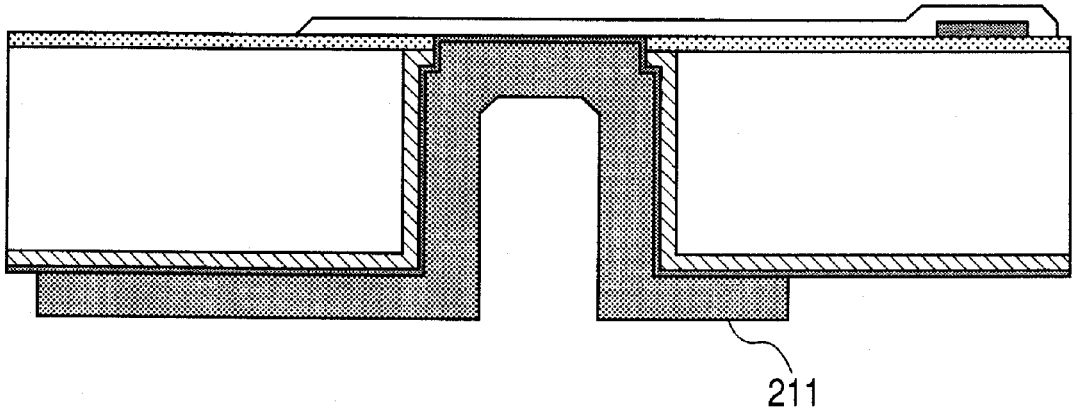

Then, a conductive layer for the electrode was formed in the through hole. First, Au serving as a plating seed layer 210 was formed by sputtering, and then, a pattern was formed with a dry film resist (ORDYL manufactured by TOKYO OHKA KOGYO CO., LTD.) (see FIG. 7A), and Cu serving as a conductive layer 211 was formed by electrolytic plating (FIG. 7B).

Figure 7C:
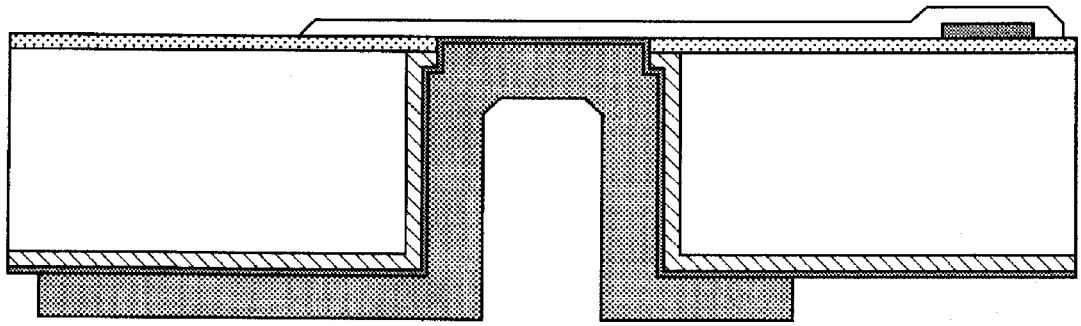

Then, the dry film was removed with an alkaline remover, and the seed layer formed in an extra region was etched to be removed (see FIG. 7C).

In this manner, the electronic device having the through electrode was obtained. Note that the energy generating elements for generating the energy utilized for discharging ink, and the ink discharge ports are disposed on the front surface of the substrate of the electronic device, for example, whereby the electronic device according to the present invention can be utilized as an ink jet head.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-066585, filed Mar. 15, 2007, which is hereby incorporated by reference herein in its entirety.

What is claimed is:

1. A method of producing an ink jet head, the ink jet head including a substrate having an element, formed on one surface thereof, for generating energy utilized for discharging an ink through a discharge port, and a supply opening, formed so as to penetrate the substrate, for supplying the ink to the discharge port, the method comprising:

providing the substrate which includes a through hole which forms the supply opening, and a layer that covers an opening of the through-hole on a side of the one surface of the substrate;

forming a protective film so that the protective film covers a side wall of the through-hole and reaches the layer;

depositing a photosensitive resin on the protective film;

applying light from the side of the one surface of the substrate to pattern the photosensitive resin; and removing the protective film formed on a portion of the opening of the through-hole on the side of the one surface of the substrate, with the patterned photosensitive resin being used as a mask.

2. A method of producing an ink jet head according to claim 1, wherein the step of applying light is performed using a photomask.

3. A method of producing an ink jet head according to claim 1, further comprising forming a light-shielding film, which becomes a mask in the step of applying light, on the one surface of the substrate in advance of the step of applying light.

4. A method of producing an ink jet head according to claim 3, wherein the light-shielding film is formed of tantalum.

5. A method of producing an ink jet head according to claim 1, wherein the protective film is formed of a parylene resin.

* * * * *